US006003791A

United States Patent [19]

Reiter

[11] Patent Number: 6,003,791

[45] **Date of Patent: *Dec. 21, 1999**

[54] FUEL INJECTOR

[75] Inventor: Ferdinand Reiter, Markgroeningen, Germany

[73] Assignee: Robert Bosch GmbH, Stuttgart, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/934,290

[22] Filed: Sep. 19, 1997

[30] Foreign Application Priority Data

Sep. 19, 1996 [DE] Germany ..... 196 38 201

[51] Int. Cl.[6] ..... B05B 1/30

[52] U.S. Cl. ..... 239/575; 239/585.5; 239/590.3

[58] Field of Search ..... 239/575, 590, 239/590.3, 553, 585.1–585.5, 900, 533.3–533.12, DIG. 23

[56] References Cited

U.S. PATENT DOCUMENTS

| | | | |
|---|---|---|---|
| 2,628,131 | 2/1953 | Haberstroh | 239/575 X |
| 3,014,665 | 12/1961 | Shames et al. | 239/575 X |
| 4,502,196 | 3/1985 | Kupper et al. | 239/397.5 X |
| 5,190,221 | 3/1993 | Reiter | 239/585.1 X |
| 5,269,468 | 12/1993 | Adiutori | 239/397.5 |
| 5,423,489 | 6/1995 | Wood | 239/575 |
| 5,494,224 | 2/1996 | Hall et al. | 239/585.5 |
| 5,642,862 | 7/1997 | Wakeman et al. | 239/585.4 |
| 5,730,368 | 3/1998 | Flik et al. | 239/515 |

FOREIGN PATENT DOCUMENTS

| | | |
|---|---|---|
| WO93/18299 | 9/1993 | WIPO . |
| WO 96/10694 | 4/1996 | WIPO . |

*Primary Examiner*—Kevin Weldon
*Attorney, Agent, or Firm*—Kenyon & Kenyon

[57] ABSTRACT

A fuel injector for fuel injection systems of internal combustion engines includes a guide disk provided upstream from a valve seat which fulfills several functions by means of special integration of design measures. In addition to guiding an axially movable valve needle, the guide disk also takes on a filter function. For this purpose, filter openings which do not allow solid particles with dimensions>60 $\mu$m to pass through are made in the guide disk. The fuel injector is particularly suitable for use in fuel injection systems of mixture-compressing, outside-ignition internal combustion engines.

13 Claims, 3 Drawing Sheets

FUEL INJECTOR

FIELD OF THE INVENTION

The present invention relates to a fuel injector for a fuel injection system of an internal combustion engine.

BACKGROUND INFORMATION

From International Application No. WO 93/18299, a fuel injector is described which has a valve seat element on which a guide element rests. This element possesses a central passage opening through which a valve needle can move axially. Outside of this central passage opening, a plurality of passage openings is produced in the guide element to permit flow through the element which are circular and uniformly arranged in the guide element in a circular shape. At the upstream face of the guide element, a thin filter element is formed as an additional component. In a center, ring-shaped filter zone, countless circular filter openings are provided. The filter element completely covers the guide element with its passage holes. Each of these two components fulfills a function which plays no role in the other component in each instance.

SUMMARY OF THE INVENTION

The fuel injector according to the present invention has the advantage that function integration is achieved in simple manner, and that this function integration is achieved in particularly cost-effective manner, by means of simplified production possibilities and a reduced number of components. According to the present invention, the function integration is achieved in that openings are provided in a component structured as a guide disk, for axial guide of a valve needle, with the flow cross-section of these openings being limited in such a way that a filter effect is completely guaranteed. The openings in the guide disk are selected to be so small, in at least one dimension in each instance, that solid particles in the fuel with dimensions>60 $\mu$m are not permitted to pass through. It is advantageous that a single component takes on the functions of guidance and filtering. This guide disk therefore increases the quality and functional reliability of the fuel injector.

In an advantageous manner, the filter openings according to the present invention are not structured in mesh shape, as in known filters or screens, but rather are structured in arc shape, slit shape, or meander shape, so that a throttle effect at the guide disk is effectively prevented.

DETAILED DESCRIPTION OF THE INVENTION

Figure 1:
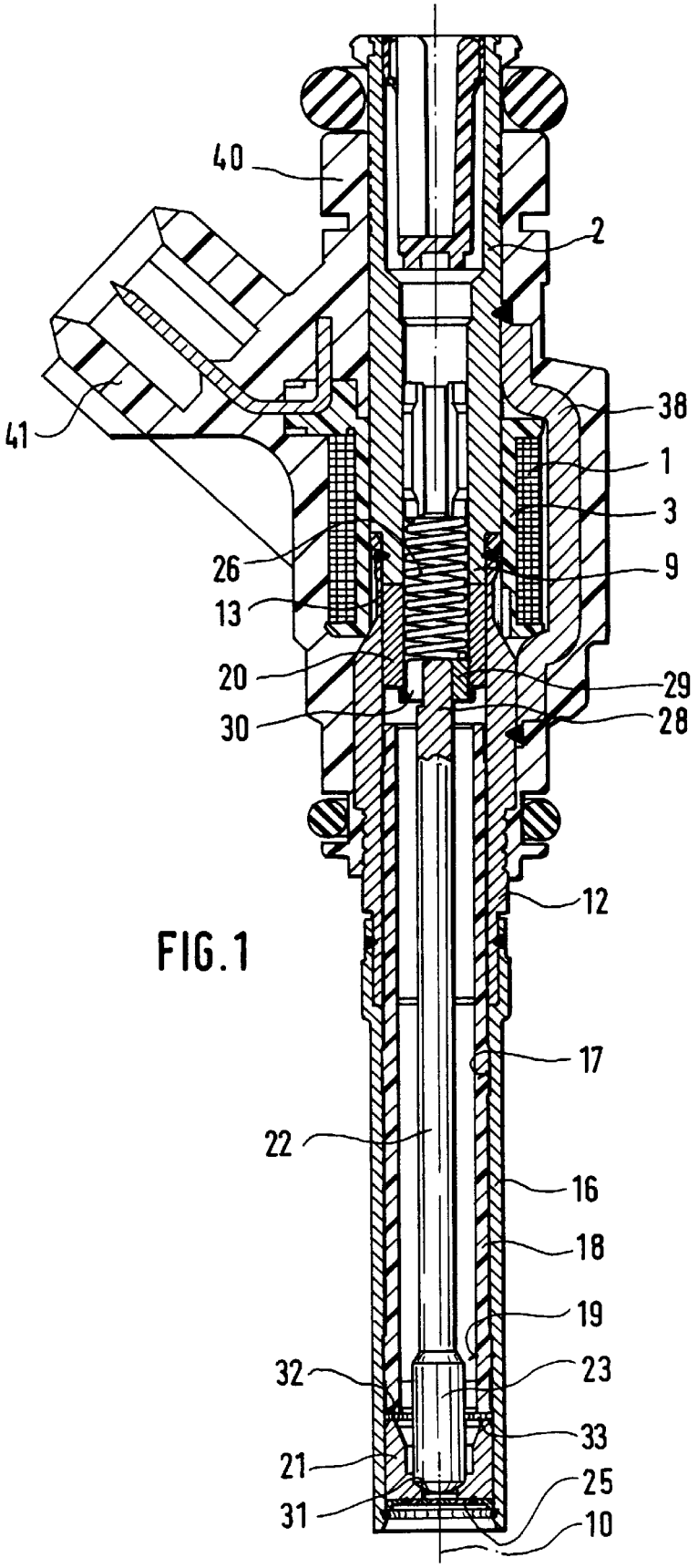
FIG. 1 shows a fuel injector with a guide disk according to an exemplary embodiment of the present invention.

The valve shown in FIG. 1, as an example, in the form of an electromagnetically activated injection valve for fuel injection systems of mixture-compressing, outside-ignition internal combustion engines, has a tube-shaped core 2 surrounded by a magnetic coil 1 and serving as the fuel inlet tap, as the so-called inner pole. A coil element 3 holds a winding of magnetic coil 1 and, in combination with core 2, allows a particularly compact structure of the injection valve in the region of magnetic coil 1.

A tube-shaped, metal connector part 12 is firmly connected with a lower core end 9 of core 2, concentric to a longitudinal valve axis 10, forming a seal, for example by means of welding, and partially surrounds core end 9 axially. Proceeding from the lower end of connector part 12, there extends a long, thin-walled, sleeve-shaped valve seat carrier 16, which can be firmly connected with connector part 12, in sealed manner, for example, and possesses a clearly forward injection point because of its relatively large axial expanse. Near core end 9, connector part 12 has a magnetic throttle location 13, which is distinguished by a significantly smaller wall thickness than the wall thicknesses of the other segments of connector part 12. This makes it possible to do without non-magnetic intermediate parts which are otherwise usually used.

A lengthwise opening 17, which is formed concentric to longitudinal valve axis 10 and against the wall of which an insulation element 18, also long and sleeve-shaped, rests, runs in valve seat carrier 16, which also serves as a connector part and is a thin-walled sleeve. Insulation element 18, made of plastic, extends over the major part of the axial expanse of connector part 12 and valve seat carrier 16, between an armature 20 and a valve seat element 21. By means of a press fit, insulation element 18, which mainly serves for thermal insulation, is firmly pressed into valve seat carrier 16, for example. In sleeve-shaped insulation element 18, an inner lengthwise opening 19 which runs concentric to longitudinal valve axis 10 is again provided. In lengthwise opening 19, a solid, rod-shaped valve needle 22 is arranged, which has a valve closing segment 23, for example in a full cylinder shape, at its downstream end.

Valve seat carrier 16, which is composed of non-magnetic steel, for example, but can also be made from a magnetic ferrite material, surrounds not only the lower end of connector part 12, but, at its opposite end, also valve seat element 21 and a spray-orifice plate 25 attached to it. With the long structure of valve seat carrier 16, the injection point of the injection valve is moved far forward, i.e., advanced. In the case of the usual installation positions of injection valves in internal combustion engines, this means that the injection valve clearly projects into the intake pipe with its downstream end and therefore with its metering and injection region. This makes it possible to avoid wetting the wall of the intake pipe, to a great extent, by means of targeted injection onto one or more intake valves, thereby reducing the exhaust gas emission of the internal combustion engine.

Activation of the injection valve takes place in known manner, e.g., electromagnetically. The electromagnetic circuit with magnetic coil 1, core 2, and armature 20 serves for an axial movement of valve needle 22 and therefore for opening the injection valve counter to the spring force of a reset spring 26, or for closing the injection valve. Armature 20, which is tube-shaped, for example, is connected with end 28 of valve needle 22 which faces away from valve closing segment 23, or with an intermediate part 29 which is pressed onto end 28, for example, by means of a weld seam, and aligned with core 2. In intermediate part 29, at least one, for example three passage openings 30 (or grooves) are provided, through which the fuel flows in the direction towards valve seat element 21. Valve seat element 21, which is cylindrical in shape, for example, and has a rigid valve seat 31, is mounted in the downstream end of valve seat carrier 16, facing away from core 2, in lengthwise opening 17, by means of welding, forming a seal.

To guide valve closing segment 23 during the axial movement of valve needle 22 with armature 20 along longitudinal valve axis 10, a guide disk 33 according to the present invention, for example attached to an upper face 32 of the valve seat element, facing away from spray-orifice plate 25, is provided. During the axial movement, armature 20 is guided in connector part 12, particularly in the region of magnetic throttle location 13. Provision can be made on the outer circumference of armature 20 for a guide surface, for example, especially developed for this purpose. Cylindrical valve closing segment 23, which has the contour of a spherical segment facing valve seat 31, acts together with valve seat 31 of valve seat element 21, which seat narrows in a truncated cone shape in the flow direction. At its face 35 which faces away from guide disk 33, valve seat element 21 is firmly connected with spray-orifice plate 25, which is pot-shaped, for example. Spray-orifice plate 25 possesses at least one, for example four injection openings 36 formed by means of erosion, punching, or etching, for example. A holder edge of spray-orifice plate 25 is bent conically outward, so that it rests against the inside wall of valve seat carrier 16 defined by lengthwise opening 17, a radial compression being present. Spray-orifice plate 25 is firmly connected with the wall of valve seat carrier 16, for example by welding, forming a seal. The components described in this paragraph can be seen particularly clearly in FIG. 2, which illustrates the valve seat region including guide disk 33, on a larger scale.

The insertion depth of valve seat element 21, which is introduced into lengthwise opening 17 following the optional insertion of insulation element 18, determines the magnitude of lift of valve needle 22. In this context, the one end position of valve needle 22, for example when magnetic coil 1 is not excited, is established by contact of valve closing segment 23 with valve seat 31, while the other end position of valve needle 22, for example when magnetic coil 1 is excited, results from contact of armature 20 on core end 9. Magnetic coil 1 is surrounded by at least one conductive element 38, for example designed as a bracket (clip) and serving as a ferromagnetic element, which surrounds magnetic coil 1 at least partially in the circumferential direction. The fuel injector is substantially surrounded by a plastic extrusion coat 40 outside of valve seat carrier 16, the plastic extrusion coat 40 including an electric connector plug 41, for example which is injection-molded on along with it.

Figure 2:
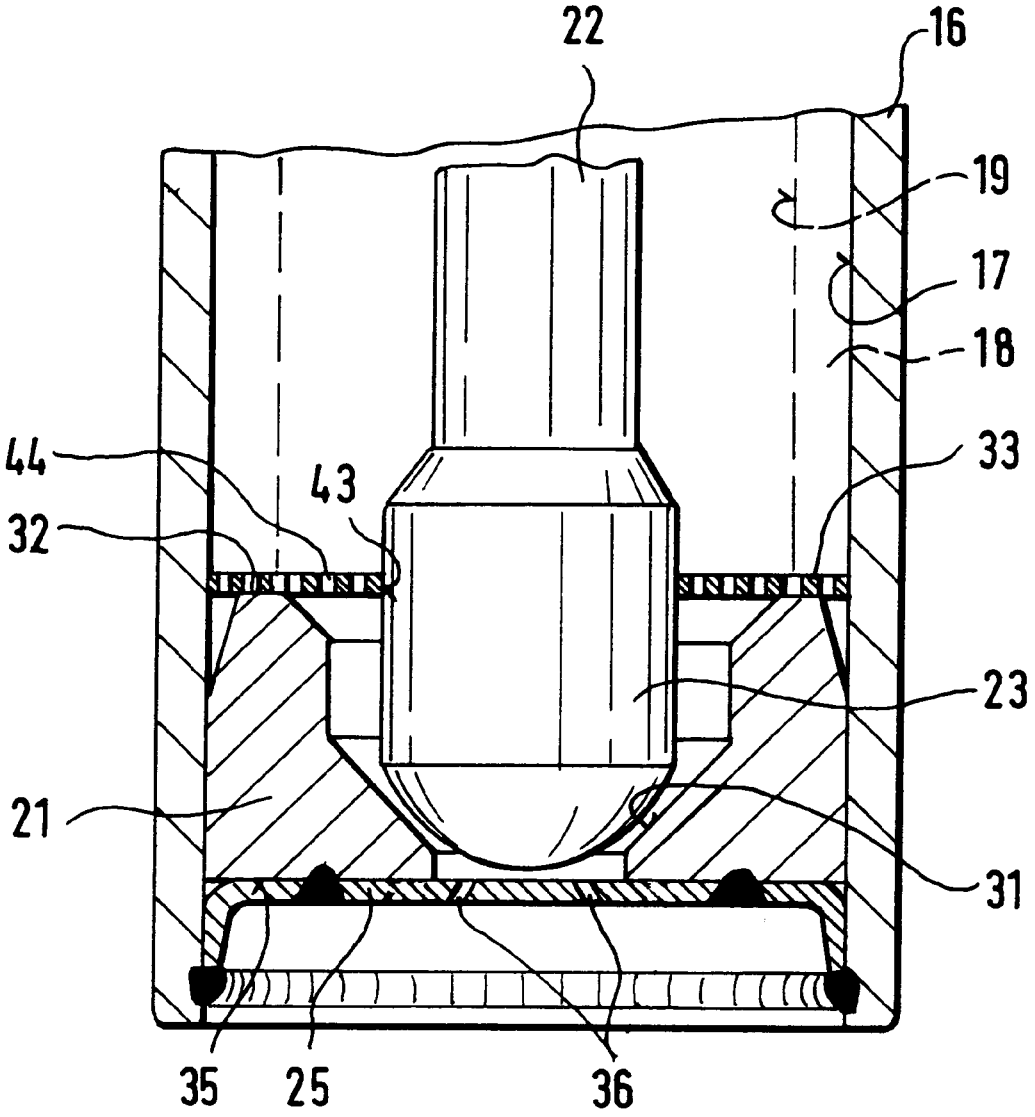
FIG. 2 shows an enlarged section of the valve according to FIG. 1 in the region of the guide disk.

FIG. 2 shows a section of the injection valve shown in FIG. 1, in the region of valve seat element 21, i.e., of guide disk 33, on a larger scale. Guide disk 33 serves for radial guidance of valve needle 22 during its axial movement in lengthwise opening 17 or 19, to avoid excessive wear on valve seat 31, and to avoid asymmetric flow conditions between valve seat 31 and injection openings 36. In addition, guide disk 33 also fulfills a filter function, in order to keep dirt particles away from valve seat 31 in simple manner; the dirt particles could otherwise cause leaks in the injection valve. Guide disk 33 has a thickness of, for example, approximately 80 $\mu$m to 150 $\mu$m. Usually, guide disk 33 is manufactured by means of punching, etching, or galvanic shaping (e.g., LIGA, MIGA technique). A central passage hole 43 is provided in circular guide disk 33; this hole has a slightly larger diameter than the outside diameter of valve closing segment 23 of valve needle 22. These dimensional differences result in a minimum play of approximately 10 $\mu$m.

Figure 3:
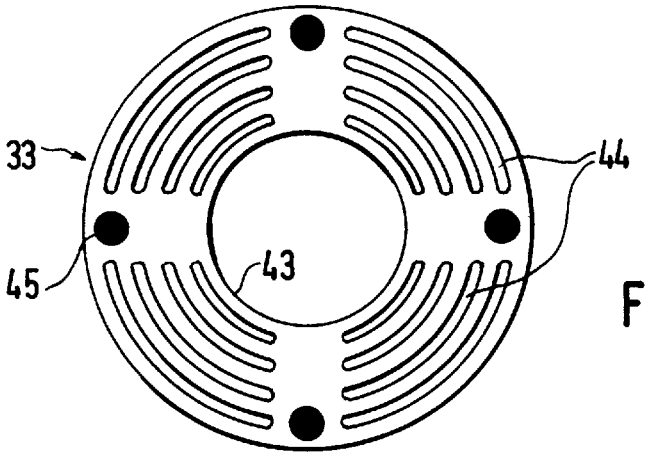
FIG. 3 shows an exemplary embodiment of a guide disk according to the present invention.
Figure 4:
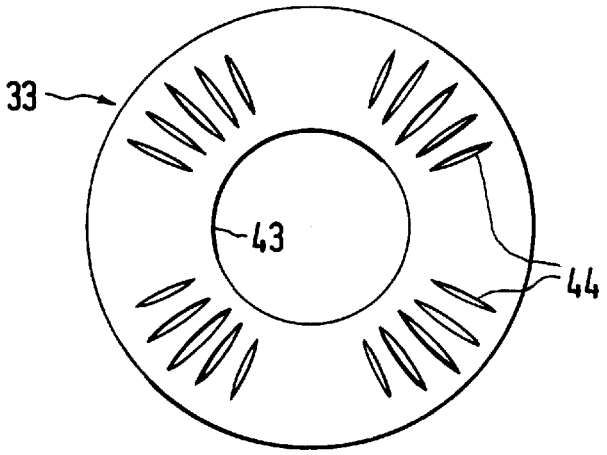
FIG. 4 shows another exemplary embodiment of a guide disk according to the present invention.
Figure 5:
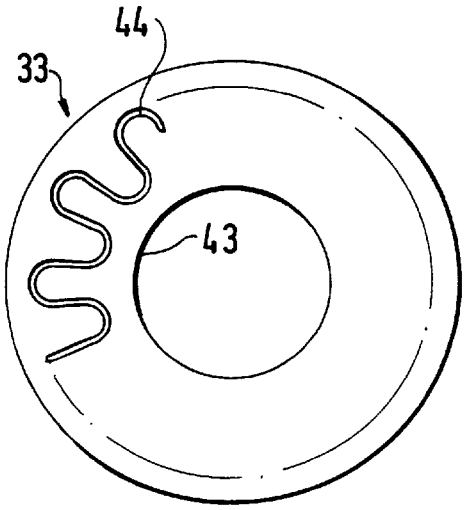
FIG. 5 shows yet another exemplary embodiment of a guide disk according to the present invention.

In guide disk 33, outside of passage hole 43, a plurality of filter openings 44 is produced, which can be at very specific geometrical positions relative to one another. Three different embodiments of arrangements of filter openings 44 according to the present invention are shown in FIGS. 3 to 5. In the example shown in FIG. 3, filter openings 44 are arranged in four sectors or complexes, in arc shape at 90° in each instance, where the arc length of individual filter openings 44 decreases slightly from the outside towards the inside, towards passage hole 43. In the exemplary embodiment according to the present invention shown in FIG. 4, filter openings 44 run radially, radiating outward, again arranged as a complex of openings in four sectors at 90°. Filter openings 44 of two diagonally opposite complexes of openings, i.e., those at 180° from one another, always have the same alignment, while the filter openings of two adjacent complexes of openings are at right angles to one another. Slit-shaped filter openings 44 possess either a constant or a changing length. The widths of filter openings 44 can also vary to a slight degree.

Likewise, meander-shaped filter openings 44 are possible, one of which is shown in FIG. 5. Several meander-shaped filter openings 44 can also be made, nested into one another. In addition to these rather unusual filter structures, known filter patterns in the form of a woven screen are also possible for guide disk 33. In any case, a maximum opening width in at least one direction/dimension, mostly the arc or slit width, of 60 $\mu$m must not be exceeded, in order to be able to fully guarantee the filter function of guide disk 33. Flow cross-sections which have a sufficient filter effect and do not permit particles>60 $\mu$m to pass through are achieved with this maximum size value. Usually, these maximum opening widths in at least one dimension lie in the range of approximately 20 $\mu$m to 60 $\mu$m.

Attachment of guide disk 33 takes place, for example, with four weld points 45 which can be made with a laser, offset from one another by 90°, close to the outside circumference, but at least at such points where guide disk 33 rests directly against top face 32 of valve seat element 21. During the installation, guide disk 33 is centered relative to valve seat 31 using a pin which has a slightly larger diameter than valve closing segment 23. In the centered state, guide disk 33 is pressed against face 32 of valve seat element 21 and subsequently attached, for example by using resistance welding or laser welding. A device, not shown, which presses guide disk 33 against valve seat element 21, covers guide disk 33 completely, except for four weld points 45. Contamination of guide disk 33, particularly in the region of filter openings 44, is effectively prevented in this way. In the installed state, guide disk 33 rests, for example, against sleeve-shaped insulation element 18, which can be optionally installed, with its top face, which is opposite valve seat element 21. Guide disk 33 according to the present invention therefore takes over both guidance of valve needle 22 and filtering of the fuel to prevent leaks at valve seat 31.

What is claimed is:

1. A fuel injector for a fuel injection system of an internal combustion engine, comprising:

a valve needle disposed in a valve seat carrier, the valve needle being moveable along a longitudinal valve axis;

a valve closing segment disposed at an end of the valve needle;

a valve seat connected to the valve seat carrier, the valve closing segment interacting with the valve seat; and a guide disk disposed upstream of the valve seat, the guide disk having one central passage and at least one filter opening integrated together within the guide disk, the central passage and the at least one filter opening being the only openings in the guide disk the central passage guiding axial movement of the valve needle, the at least one filter opening extending through a thickness of the guide disk, a flow cross-section of the at least one filter opening achieving a filter effect preventing solid particles having a dimension greater than 60 $\mu$m to pass through the at least one filter opening.

2. The fuel injector according to claim 1, wherein the at least one filter opening includes a plurality of filter openings.

3. The fuel injector according to claim 1, wherein the guide disk has a thickness in a range between 80 $\mu$m and 150 $\mu$m.

4. The fuel injector according to claim 1, wherein the guide disk is produced via galvanic shaping.

5. The fuel injector according to claim 1, wherein the at least one filter opening is structured in an arc shape.

6. The fuel injector according to claim 1, wherein the at least one filter opening includes narrow radial slits extending radially outwards.

7. The fuel injector according to claim 1, wherein the at least one filter opening is structured in a meander shape.

8. The fuel injector according to claim 2, wherein a portion of the plurality of filter openings are formed into a complex of openings distributed over a surface of the guide disk.

9. The fuel injector according to claim 1, wherein the valve seat is formed in a valve seat element having an upper face, the upper face being attached to the guide disk.

10. The fuel injector according to claim 9, wherein a connection of the guide disk to the valve seat element is via weld points.

11. The fuel injector according to claim 9, further comprising an insulation element connected to the valve seat carrier, the guide disk resting against the insulation element at an upper surface facing away from the valve seat element.

12. The fuel injector according to claim 1, wherein the central passage and the at least one filter opening are co-planar with each other.

13. The fuel injector according to claim 1, wherein the guide disk is situated within a plane, a width of the at least one filter opening being substantially equal to 60 $\mu$m, the width being defined within the plane.

* * * * *